US010059354B2

(12) United States Patent
Kernwein

(10) Patent No.: US 10,059,354 B2
(45) Date of Patent: Aug. 28, 2018

(54) LOCOMOTIVE-TO-WAYSIDE DEVICE COMMUNICATION SYSTEM AND METHOD AND WAYSIDE DEVICE THEREFOR

(71) Applicant: Westinghouse Air Brake Technologies Corporation, Wilmerding, PA (US)

(72) Inventor: Jeffrey D. Kernwein, Cedar Rapids, IA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 15/252,418

(22) Filed: Aug. 31, 2016

(65) Prior Publication Data

US 2016/0368514 A1 Dec. 22, 2016

Related U.S. Application Data

(63) Continuation of application No. 14/294,689, filed on Jun. 3, 2014, now Pat. No. 9,469,317.

(51) Int. Cl.

| | |
|---|---|
| ***B61L 15/00*** | (2006.01) |
| ***B61L 3/12*** | (2006.01) |
| ***B61L 25/02*** | (2006.01) |
| ***B61L 27/00*** | (2006.01) |

(52) U.S. Cl.

CPC ..... *B61L 15/0018* (2013.01); *B61L 3/125* (2013.01); *B61L 15/0027* (2013.01); *B61L 25/025* (2013.01); *B61L 27/0005* (2013.01); *B61L 27/0077* (2013.01); *B61L 27/0088* (2013.01)

(58) Field of Classification Search

CPC .. B61L 15/0018; B61L 15/0027; B61L 3/125; B61L 25/025; B61L 27/0005; B61L 27/0077; B61L 27/0088

See application file for complete search history.

(56) References Cited

U.S. PATENT DOCUMENTS

| | | | | |
|---|---|---|---|---|
| 5,377,938 | A | 1/1995 | Bezos et al. | |
| 5,528,623 | A * | 6/1996 | Foster, Jr. ..... | H04B 1/7156 375/133 |
| 6,122,263 | A | 9/2000 | Dahlin et al. | |
| 6,322,025 | B1 | 11/2001 | Colbert et al. | |
| 6,680,918 | B1 | 1/2004 | Haley | |
| 6,782,044 | B1 | 8/2004 | Wright et al. | |
| 6,854,691 | B2 | 2/2005 | Kraeling et al. | |
| 6,996,461 | B2 | 2/2006 | Kane et al. | |
| 8,811,517 | B2 | 8/2014 | Ihm et al. | |
| 8,914,167 | B2 | 12/2014 | Smith | |

(Continued)

*Primary Examiner* — Aaron L Troost
(74) *Attorney, Agent, or Firm* — The Webb Law Firm

(57) ABSTRACT

A locomotive-to-wayside device communication system for a train having a locomotive travelling in a track network having wayside devices associated therewith. The system includes: an on-board communication device associated with the locomotive for transmitting and receiving data; and a wayside communication device associated with a wayside device, wherein the wayside communication device is programmed or configured to transmit data at or over (a) at least one power level, (b) at least one reporting interval, (c) at least one frequency, (d) at least one communication protocol, or any combination thereof. A wayside communication device and a locomotive-to-wayside device communication method are also disclosed.

17 Claims, 3 Drawing Sheets

(56) References Cited

U.S. PATENT DOCUMENTS

| | | | | |
|---|---|---|---|---|
| 2003/0214417 | A1* | 11/2003 | Peltz | B61L 3/125 340/4.3 |
| 2007/0236079 | A1 | 10/2007 | Kull | |
| 2010/0069014 | A1 | 3/2010 | Haartsen et al. | |
| 2011/0238242 | A1* | 9/2011 | Nichter | B61L 27/0005 701/19 |
| 2013/0299645 | A1 | 11/2013 | Cooper et al. | |
| 2013/0336270 | A1 | 12/2013 | Nagata et al. | |
| 2014/0191090 | A1* | 7/2014 | Busse | B61L 29/284 246/126 |
| 2014/0211771 | A1* | 7/2014 | Kim | H04W 84/12 370/338 |
| 2014/0274224 | A1 | 9/2014 | Patel et al. | |
| 2015/0336594 | A1 | 11/2015 | Yoon et al. | |

* cited by examiner

LOCOMOTIVE-TO-WAYSIDE DEVICE COMMUNICATION SYSTEM AND METHOD AND WAYSIDE DEVICE THEREFOR

CROSS REFERENCE TO RELATED APPLICATION

This application is a continuation of U.S. application Ser. No. 14/294,689 filed Jun. 3, 2014, the disclosure of which is hereby incorporated in its entirety by reference.

BACKGROUND OF THE INVENTION

Field of the Invention

This invention relates generally to vehicle systems and networks, such as railway systems including trains travelling in a track or rail network, and in particular to a locomotive-to-wayside device communication system and method for use in implementing a communications architecture in a vehicle network, preferably a vehicle network of multiple trains operating in a railroad track network.

Description of Related Art

Vehicle systems and networks exist throughout the world, and, at any point in time, a multitude of vehicles, such as cars, trucks, buses, trains, and/or the like, are travelling throughout the system and network. With specific reference to trains travelling in a railroad track network, the locomotives of such trains may be equipped with or operated using train control, communication, and management systems (e.g., positive train control systems), such as the I-ETMS® of Wabtec Corp. In order to effectively manage all of the trains, information and data must be communicated and distributed over the network between the trains, i.e., the locomotives, a central control system, e.g., central dispatch, and various wayside devices, e.g., wayside interface units (WIUs), radios, track communication devices, and other equipment positioned throughout the track network.

As is currently implemented in existing train control, communication, and management systems, the wayside devices, i.e., the data radios of such devices, are configured to either passively respond to an inquiry from the train management computer on the locomotive, or actively and continually transmit data to the train management computer.

When implemented in the above-mentioned passive system, the wayside device is in a "sleep" state awaiting an interrogation signal from the communication system of the train management computer on the locomotive. Based upon the location or position of the train with respect to the wayside device, the locomotive will transmit such an interrogation signal, which "wakes up" the wayside device, such that it enters an active state. In this active state, and based upon the nature and content of the interrogation signal, the wayside device will transmit data associated with the track, the environment, a configurable device (e.g., a switch), the device itself, or other specified information. Once the data is transmitted to the train management computer, the wayside device again enters the "sleep" or passive mode until another interrogation signal is received. One example of a train control system operating in this "passive" implementation is shown and described in U.S. Pat. No. 6,996,461. In the "active" implementation, the wayside device continually transmits the data to the network, regardless of whether or not a train is in the area.

The "passive" implementation is normally used in areas where a continual power source is not available. Accordingly, the wayside device is provided with one or more batteries to supply power to the device, and facilitate the data collection and transmission functions. The "active" implementation can be used in areas that have a permanent power source available, such that the wayside device is hardwired to a power source or system. If the battery-powered wayside devices were to continually transmit, the batteries would drain at a rapid rate, and require replacement or require large infrastructure (wind generators, solar panels, and/or the like) or some other replenishable power source to keep up with the power demands.

Accordingly, there is a need in the art for more effective and efficient communication systems for distributing data and information over a large network, such as a train network. There is also a need in the art for a locomotive-to-wayside device communication system and method that can be used in areas or environments where a permanent power source is not available, or such use not desirable.

SUMMARY OF THE INVENTION

Generally, provided are improved locomotive-to-wayside device communication systems and methods and wayside devices therefor. Preferably, provided are locomotive-to-wayside device communication systems and methods and wayside devices therefor that are useful in connection with railway systems and the trains travelling therein. Preferably, provided are locomotive-to-wayside device communication systems and methods and wayside devices therefor that facilitate the ability to manage and distribute data between locomotives and/or trains travelling in a track or rail network and specified wayside devices. Preferably, provided are locomotive-to-wayside device communication systems and methods and wayside devices therefor that facilitate effective communication and data exchange between trains and wayside devices in order to accurately manage train operations and transit. Preferably, provided are locomotive-to-wayside device communication systems and methods and wayside devices therefor that improve energy efficiency in the operation of the wayside devices in a rail or track network.

According to one preferred and non-limiting embodiment, provided is a locomotive-to-wayside device communication system for at least one train having at least one locomotive travelling in a track network having a plurality of wayside devices associated therewith. The system includes: at least one on-board communication device associated with the at least one locomotive and configured to transmit and receive data; and at least one wayside communication device associated with at least one of the plurality of wayside devices, wherein the at least one wayside communication device is configured to transmit data at or over at least one of the following: (a) at least one power level, (b) at least one reporting interval, (c) at least one frequency, (d) at least one communication protocol, or any combination thereof.

In another preferred and non-limiting embodiment, provided is a wayside communication device associated with a track network. The device includes at least one wayside communication device configured to transmit data at or over at least one of the following: (a) at least one power level, (b) at least one reporting interval, (c) at least one frequency, (d) at least one communication protocol, or any combination thereof, directly or indirectly to at least one on-board communication device associated with at least one locomotive of a train.

In a further preferred and non-limiting embodiment, provided is a computer-implemented communication method for at least one train having at least one locomotive travelling in a track network having a plurality of wayside devices associated therewith. The method includes: transmitting data, by at least one wayside communication device associated with at least one of the plurality of wayside devices, at or over at least one of the following: (a) at least one power level, (b) at least one reporting interval, (c) at least one frequency, (d) at least one communication protocol, or any combination thereof; and receiving, by at least one on-board communication device associated with the at least one locomotive of the train, at least a portion of the transmitted data.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various FIGURES. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
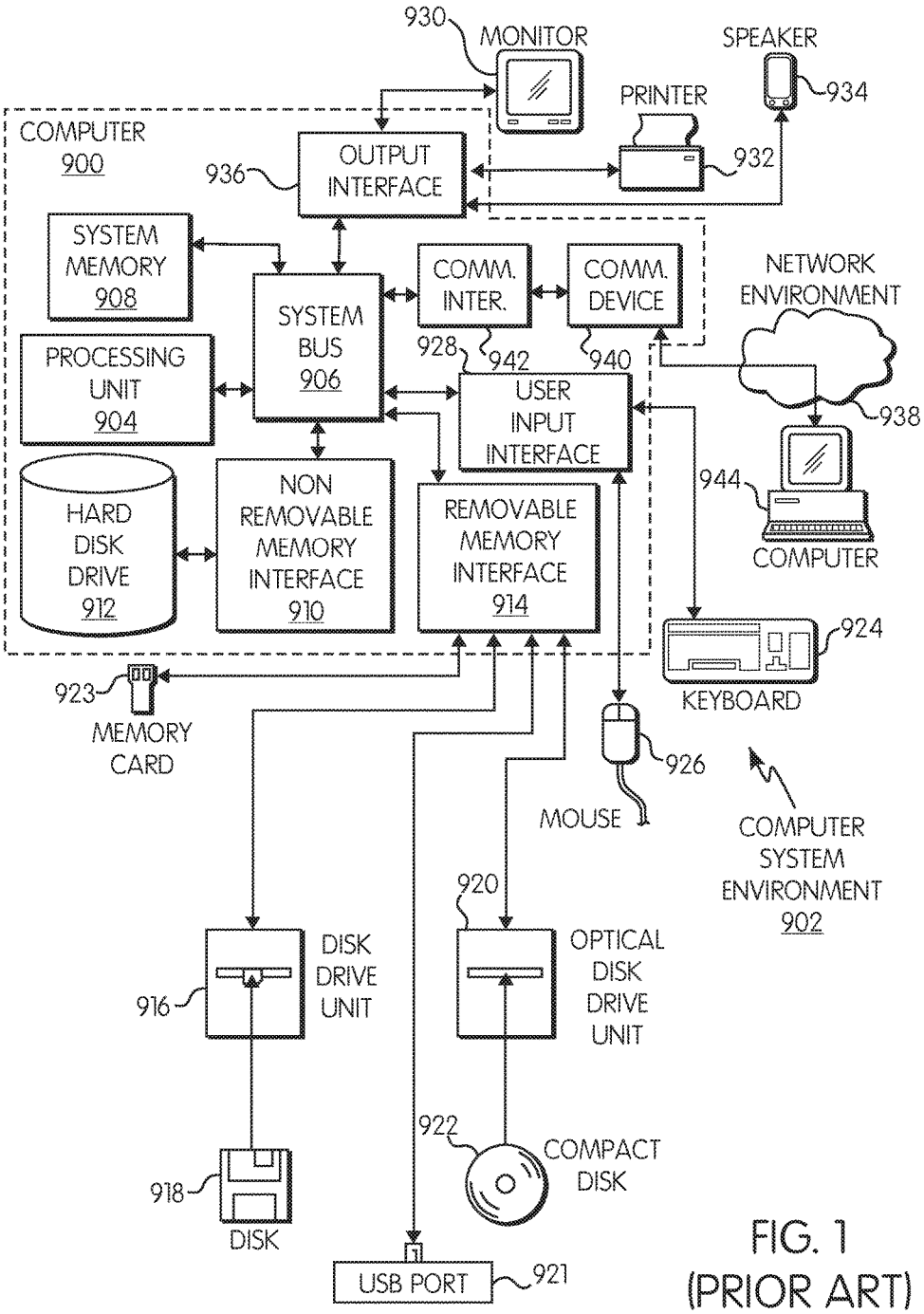
FIG. 1 (PRIOR ART)
FIG. 1 is a schematic diagram of a computer and network infrastructure according to the prior art.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, and/or the like. In addition, the communications may occur either wirelessly over a network or as transmissions that are distributed through and along the rails of a track in a track or rail network. The present invention, including the various computer-implemented and/or computer-designed aspects and configurations, may be implemented on a variety of computing devices and systems, including the client devices and/or server computer, wherein these computing devices include the appropriate processing mechanisms and computer-readable media for storing and executing computer-readable instructions, such as programming instructions, code, and/or the like. In addition, aspects of this invention may be implemented on existing controllers, control systems, and computers integrated or associated with, or positioned on, the locomotive and/or any of the railcars. For example, the presently-invented system or any of its functional components can be implemented wholly or partially on a train management computer, a Positive Train Control computer, an on-board controller or computer, a railcar computer, and/or the like. In addition, the presently-invented systems and methods may be implemented in a laboratory environment in one or more computers or servers. Still further, the functions and computer-implemented features of the present invention may be in the form of software, firmware, hardware, programmed control systems, microprocessors, and/or the like.

As shown in FIG. 1, and according to the prior art, personal computers 900, 944, in a computing system environment 902 may be provided or utilized. This computing system environment 902 may include, but is not limited to, at least one computer 900 having certain components for appropriate operation, execution of code, and creation and communication of data. For example, the computer 900 includes a processing unit 904 (typically referred to as a central processing unit or CPU) that serves to execute computer-based instructions received in the appropriate data form and format. Further, this processing unit 904 may be in the form of multiple processors executing code in series, in parallel, or in any other manner for appropriate implementation of the computer-based instructions.

In order to facilitate appropriate data communication and processing information between the various components of the computer 900, a system bus 906 is utilized. The system bus 906 may be any of several types of bus structures, including a memory bus or memory controller, a peripheral bus, or a local bus using any of a variety of bus architectures. In particular, the system bus 906 facilitates data and information communication between the various components (whether internal or external to the computer 900) through a variety of interfaces, as discussed hereinafter.

The computer 900 may include a variety of discrete computer-readable media components. For example, this computer-readable media may include any media that can be accessed by the computer 900, such as volatile media, non-volatile media, removable media, non-removable media, etc. As a further example, this computer-readable media may include computer storage media, such as media implemented in any method or technology for storage of information, such as computer-readable instructions, data structures, program modules, or other data, random access memory (RAM), read only memory (ROM), electrically erasable programmable read only memory (EEPROM), flash memory, or other memory technology, CD-ROM, digital versatile disks (DVDs), or other optical disk storage, magnetic cassettes, magnetic tape, magnetic disk storage, or other magnetic storage devices, or any other medium which can be used to store the desired information and which can be accessed by the computer 900. Further, this computer-readable media may include communications media, such as computer-readable instructions, data structures, program modules, or other data in other transport mechanisms and include any information delivery media. Computer-readable media may include all machine-readable media with the sole exception of transitory, propagating signals. Of course, combinations of any of the above should also be included within the scope of computer-readable media.

As seen in FIG. 1, the computer 900 further includes a system memory 908 with computer storage media in the form of volatile and non-volatile memory, such as ROM and RAM. A basic input/output system (BIOS) with appropriate computer-based routines assists in transferring information between components within the computer 900 and is normally stored in ROM. The RAM portion of the system memory 908 typically contains data and program modules that are immediately accessible to or presently being operated on by processing unit 904, e.g., an operating system, application programming interfaces, application programs, program modules, program data and other instruction-based computer-readable codes.

With continued reference to FIG. 1, the computer 900 may also include other removable or non-removable, volatile or non-volatile computer storage media products. For example, the computer 900 may include a non-removable memory interface 910 that communicates with and controls a hard disk drive 912, i.e., a non-removable, non-volatile magnetic medium; and a removable, non-volatile memory interface 914 that communicates with and controls a magnetic disk drive unit 916 (which reads from and writes to a removable, non-volatile magnetic disk 918), an optical disk drive unit 920 (which reads from and writes to a removable, non-volatile optical disk 922, such as a CD ROM), a Universal Serial Bus (USB) port 921 for use in connection with a removable memory card, etc. However, it is envisioned that other removable or non-removable, volatile or non-volatile computer storage media can be used in the exemplary computing system environment 900, including, but not limited to, magnetic tape cassettes, DVDs, digital video tape, solid state RAM, solid state ROM, etc. These various removable or non-removable, volatile or non-volatile magnetic media are in communication with the processing unit 904 and other components of the computer 900 via the system bus 906. The drives and their associated computer storage media discussed above and illustrated in FIG. 1 provide storage of operating systems, computer-readable instructions, application programs, data structures, program modules, program data and other instruction-based computer-readable code for the computer 900 (whether duplicative or not of this information and data in the system memory 908).

A user may enter commands, information, and data into the computer 900 through certain attachable or operable input devices, such as a keyboard 924, a mouse 926, etc., via a user input interface 928. Of course, a variety of such input devices may be utilized, e.g., a microphone, a trackball, a joystick, a touchpad, a touch-screen, a scanner, etc., including any arrangement that facilitates the input of data, and information to the computer 900 from an outside source. As discussed, these and other input devices are often connected to the processing unit 904 through the user input interface 928 coupled to the system bus 906, but may be connected by other interface and bus structures, such as a parallel port, game port, or a universal serial bus (USB). Still further, data and information can be presented or provided to a user in an intelligible form or format through certain output devices, such as a monitor 930 (to visually display this information and data in electronic form), a printer 932 (to physically display this information and data in print form), a speaker 934 (to audibly present this information and data in audible form), etc. All of these devices are in communication with the computer 900 through an output interface 936 coupled to the system bus 906. It is envisioned that any such peripheral output devices be used to provide information and data to the user.

The computer 900 may operate in a network environment 938 through the use of a communications device 940, which is integral to the computer or remote therefrom. This communications device 940 is operable by and in communication to the other components of the computer 900 through a communications interface 942. Using such an arrangement, the computer 900 may connect with or otherwise communicate with one or more remote computers, such as a remote computer 944, which may be a personal computer, a server, a router, a network personal computer, a peer device, or other common network nodes, and typically includes many or all of the components described above in connection with the computer 900. Using appropriate communication devices 940, e.g., a modem, a network interface or adapter, etc., the computer 900 may operate within and communication through a local area network (LAN) and a wide area network (WAN), but may also include other networks such as a virtual private network (VPN), an office network, an enterprise network, an intranet, the Internet, etc. It will be appreciated that the network connections shown are exemplary and other means of establishing a communications link between the computers 900, 944 may be used.

As used herein, the computer 900 includes or is operable to execute appropriate custom-designed or conventional software to perform and implement the processing steps of the method and system of the present invention, thereby, forming a specialized and particular computing system. Accordingly, the presently-invented method and system may include one or more computers 900 or similar computing devices having a computer-readable storage medium capable of storing computer-readable program code or instructions that cause the processing unit 902 to execute, configure or otherwise implement the methods, processes, and transformational data manipulations discussed hereinafter in connection with the present invention. Still further, the computer 900 may be in the form of any type of computing device having the necessary processing hardware to appropriately process data to effectively implement the presently-invented computer-implemented method and system.

The computer-implemented method and system may be implemented in a variety of systems and vehicular networks; however, the methods and systems described herein are particularly useful in connection with a railway system and network. Accordingly, the presently-invented methods and systems can be implemented in various known train control and management systems, e.g., the above-referenced I-ETMS® of Wabtec Corp.

Figure 2:
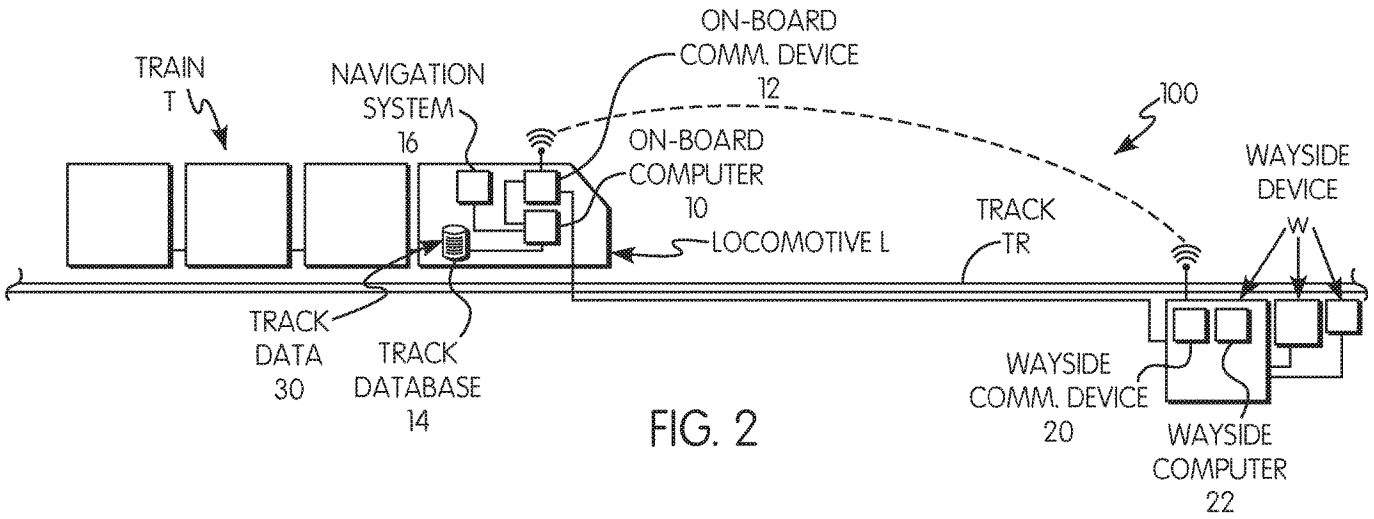
FIG. 2 is a schematic view of one embodiment of a locomotive-to-wayside device communication system according to the principles of the present invention.

The presently-invented system and methods can be implemented in connection with a variety of train types and railroad systems. In one preferred and non-limiting embodiment, and as illustrated in FIG. 2, the systems and methods described herein may be implemented on a train (T) with at least one locomotive (L) having an on-board computer 10. The on-board computer 10 (or on-board controller, on-board computer system, train management computer, and/or the like) includes or is in communication with an on-board communication device 12, which may facilitate or implement the various communications and data transfers or exchanges, as discussed hereinafter. For example, the on-board communication device may be programmed, configured, or controlled to receive, process, and/or transmit data wirelessly (e.g., over a train network, a railroad network, a local area network, a wide area network, via satellite communication, and/or the like) or directly over rail of the track (TR) on which the train (T) is travelling. As discussed above, any type of data communications and/or communications protocols are contemplated within the spirit, scope, and context of the present invention.

The on-board computer 10 also includes or is integrated with a track database 14 populated with track data, railroad data, data directed to a wayside device (W), train data, position data, operation data, and the on-board computer 10 also includes the appropriate software or programs to effectively implement the systems and methods according to the present invention. In addition, and in one preferred and non-limiting embodiment, the on-board computer 12 receives real-time inputs from various locomotive control settings, sensors, and a navigation system 16, such as a GPS receiver. Of course, it is envisioned that any type of train management system and arrangement can be used within the context and scope of the present invention.

With continued reference to FIG. 2, and in one preferred and non-limiting embodiment, provided is a locomotive-to-wayside device communication system 100 for at least one train (T) having at least one locomotive (L) travelling on a track (TR) (in a track network), which includes multiple wayside devices (W) associated therewith. In this embodiment, the system 100 includes the above-discussed on-board communication device 12 associated with the locomotive (L). This on-board communication device 12 is programmed or configured to transmit, process, and/or directly or indirectly receive data. In addition, the system 100 includes at least one wayside communication device 20 associated with at least one of the wayside devices (W). As with the on-board communication device 12, the wayside communication device 20 is programmed or configured to transmit, process, and/or directly or indirectly receive data. As discussed hereinafter, the wayside communication device 20 may be in communication with and/or controlled by a wayside computer 22 (which is also positioned within, integrated with, or in communication with the wayside device (W). In addition, the on-board communication device 12 and the wayside communication device 20 may directly or indirectly communication. For example, information and data from one wayside communication device 20 may be indirectly received by the on-board communication device 12, such as from some intermediate device, repeater device, other wayside communication device 20, and/or the like.

In this preferred and non-limiting embodiment, the wayside communication device 20 (and/or the wayside computer 22) is programmed or configured to transmit or cause the transmission of data at or over (a) at least one power level, (b) at least one reporting interval, (c) at least one frequency, (d) at least one communication protocol, or any combination thereof. In particular, the wayside communication device 20 is either programmed or configured to transmit data, or alternatively, the wayside computer 22 is programmed or configured to control the wayside communication device 20 to effect such transmission (and/or receipt) of data. The transmission of the data from the wayside communication device 20 may be wirelessly through radio communication, over a network (e.g., a train network, a railroad network, a wide area network, a local area network, and/or the like), or any other known wireless communication protocol. Alternatively, the transmission of data may occur over the track (TR). Accordingly, the on-board communication device 12 is programmed or configured to receive or transmit data using the same or similar protocols. The selection of the power level and/or the reporting interval may occur at the wayside device (W) (by the wayside computer 22), at the train (T) (by the on-board computer 10), or based upon the system-level specifications.

In another preferred and non-limiting embodiment, and as discussed, the wayside communication device 20 (and/or the wayside computer 22) is programmed or configured to transmit or cause the transmission of the data at or over at least one (communication or transmission) frequency and/or at or over at least one communication protocol. The selection of the frequency and/or communication protocol may occur at the wayside device (W) (by the wayside computer 22), at the train (T) (by the on-board computer 10), or based upon the system-level specifications. The frequency and/or communication protocol may be modified, adjusted, identified, determined, and/or selected based upon a variety of factors and conditions, such that the frequency and/or communication protocol may be variable, adjustable, configurable, incremental, continuous, and/or the like. Again, the selection of determination of the frequency and/or the communication protocol may be used alone or in connection with the power level and/or reporting interval selection or determination, with the common goal of facilitating effective communication between the train (T) and the wayside devices (W).

In a further preferred and non-limiting embodiment, one or more of the power level, the reporting interval, the frequency, and/or the communication protocol of the data transmission are determined at least partially based upon at least one of the following: available power level (e.g., power level available to the wayside communication device 20 for use in transmitting the data and/or messages), track position (e.g., the position of the track or section of track with relation to other tracks or in the environment), track location (e.g., the location of the track or section of track in the track network), track usage (e.g., the traffic conditions or use of the track or section of track), time (e.g., the time of day, a configurable time period, a predetermined time period, and/or the like), environment (the location of the wayside device (W), the terrain, the weather conditions, and/or the like), or any combination thereof.

Figure 3:
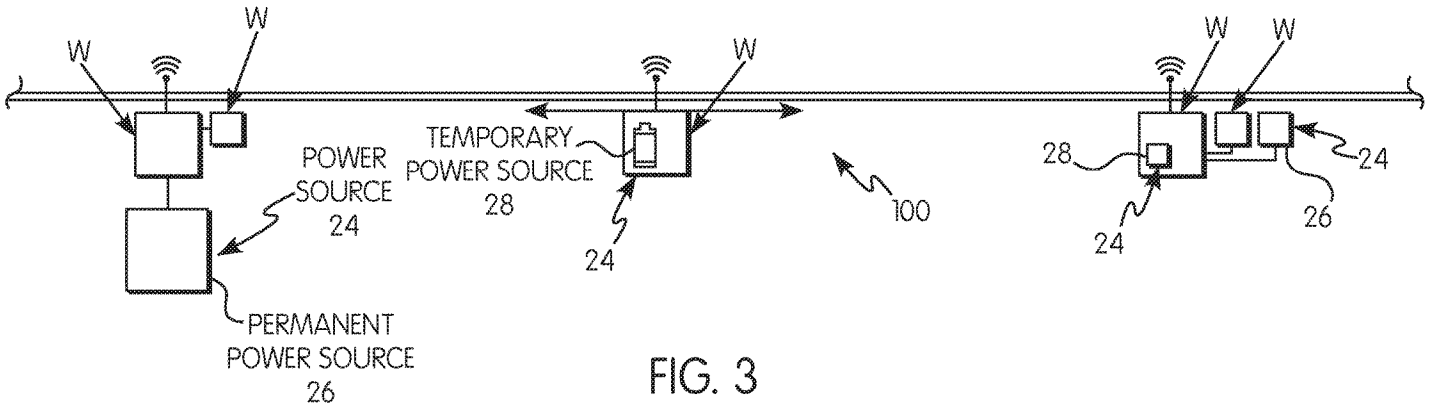
FIG. 3 is a schematic view of another embodiment of a locomotive-to-wayside device communication system according to the principles of the present invention.

In another preferred and non-limiting embodiment, the power level of the transmission is determined at least partially based upon available power source 24, i.e., the power source or resources that are available to the wayside device (W) or the wayside communication device (20) (or the wayside computer 22). For example, and with reference to FIG. 3, this available power source 24 may be in the form of a permanent power source 26, such as a commercial power source, an industrial power source, some existing power distribution device or source, and/or the like, and/or a temporary power source 28, such as a battery power source. These power sources 24 may be used in connection with one or more wayside devices (W) (or any of the individual components thereof, e.g., the wayside communication device 20, the wayside computer 22, and/or the like) or any of the configurable devices associated or in direct or indirect communication with the wayside device (W). In addition, the wayside computer 22 can be programmed or configured to select the power level of the transmission based upon the identification of the available power source, and the detection of a change in available power or the availability of the presently-selected power source.

In another preferred and non-limiting embodiment, the power level is in the form of at least one high power level and at least one low power level. In another embodiment, the at least one high power level is from about 1 watt to about 10 watts, and the low power level is from about 1 milliwatt to about 500 milliwatts. Of course, this high power level or low power level may be configurable or adjusted based upon the available power at any given time or time period, the identification of the available or preferable power source, and/or the presence or absence of an approaching train (T). Accordingly, the selected power level for transmission of data from the wayside device (W) may be chosen from a table of power levels, may be determined based upon a determination of the wayside computer 22, may be determined based upon a determination of the on-board computer 10, and/or the like. As discussed hereinafter, the power level may be modified, adjusted, identified, determined, and/or selected based upon a variety of factors and conditions, such that the power level may be variable, adjustable, configurable, incremental, continuous, and/or the like.

In another preferred and non-limiting embodiment, the reporting interval is in the form of at least one high frequency reporting interval and at least one low frequency reporting interval. In another embodiment, the at least one high frequency reporting interval is from about 1 second to about 30 seconds, preferably from about 1 second to about 6 seconds, and the at least one low frequency reporting interval is from about 31 seconds to about 2 minutes, preferably from about 7 seconds to about 2 minutes. As discussed above in connection with the power level, the high frequency reporting interval or the low frequency reporting level may be configurable or adjusted based upon the presence or absence of an approaching train (T) and/or the identification of a preferable reporting interval. Accordingly, the selected reporting interval for transmission of data from the wayside device (W) may be chosen from a table of reporting intervals, may be determined based upon a determination of the wayside computer 22, may be determined based upon a determination of the on-board computer 10, and/or the like. As discussed hereinafter, the reporting interval may be modified, adjusted, identified, determined, and/or selected based upon a variety of factors and conditions, such that the reporting interval may be variable, adjustable, configurable, incremental, continuous, and/or the like.

In another preferred and non-limiting embodiment, the frequency of the transmission or communication may be selected from a set of standard or acceptable frequencies, as indicated by the railroad and/or populated in the track database 14. Of course, the frequency may be configurable or adjusted based upon the available frequencies at any given time or time period, the identification of the available or preferable frequency, and/or the presence or absence of an approaching train (T). Accordingly, the selected frequency for transmission of data from the wayside device (W) may be chosen from a table of frequencies, may be determined based upon a determination of the wayside computer 22, may be determined based upon a determination of the on-board computer 10, and/or the like. As discussed hereinafter, the frequency may be modified, adjusted, identified, determined, and/or selected based upon a variety of factors and conditions, such that the frequency may be variable, adjustable, configurable, incremental, continuous, and/or the like.

In another preferred and non-limiting embodiment, the communication protocol use in connection with the transmission or communication may be selected from a set of standard or acceptable protocols, as indicated by the railroad and/or populated in the track database 14. Of course, the communication protocol may be configurable or adjusted based upon the available protocols at any given time or time period, the identification of the available or preferable protocol, and/or the presence or absence of an approaching train (T). Accordingly, the selected communication protocol for transmission of data from the wayside device (W) may be chosen from a table of protocols, may be determined based upon a determination of the wayside computer 22, may be determined based upon a determination of the on-board computer 10, and/or the like. As discussed hereinafter, the communication protocol may be modified, adjusted, identified, determined, and/or selected based upon a variety of factors and conditions, such that the protocol may be variable, adjustable, configurable, incremental, continuous, and/or the like.

In another preferred and non-limiting embodiment, the on-board communication device 12 is at least partially controlled by the on-board computer 10 of the locomotive (L), and the on-board computer 10 is in communication or integrated with the track database 14, which is populated with track data 30. This track data 30 may include one or more of the following: track location data, track position data, geographic data, map data, track usage data, wayside device data, wayside location data, wayside position data, and/or wayside communication device data. In one embodiment, the on-board computer 12 is programmed or configured to determine locomotive (L) position in the track network based at least partially on at least a portion of the track data 30, and determine upcoming wayside communication device 20 location in the track network based at least partially on the locomotive (L) position and at least a portion of the track data 30. Based upon transmissions directly or indirectly received at the on-board communication device 12 from at least one upcoming wayside communication device 20, the on-board computer 10 is programmed or configured as follows: (i) if data is received from the upcoming wayside communication device 20, implement at least one action; and (ii) if data is not received from the wayside communication device 20, transmit an instruction to modify at least one of the following: the power level, the reporting interval, the frequency, the communication protocol, or any combination thereof.

The transmission of an instruction to modify the power level, reporting interval, frequency, and/or communication protocol may occur based upon the non-receipt of data, or alternatively, based upon the nature and content of the data. Further, and in another preferred and non-limiting embodiment, the instruction may be or include at least one of the following: (i) an instruction to modify a current power level to high power level; (ii) an instruction to modify the current power level to an increased power level; (iii) an instruction to modify the current power level to a specified power level;

(iv) an instruction to incrementally modify the current power level to a higher power level; (v) an instruction to modify a current reporting interval to a high frequency reporting interval; (vi) an instruction to modify the current reporting interval to an increased reporting interval; (vii) an instruction to modify the current reporting interval to a specified reporting interval; (viii) an instruction to incrementally modify the current reporting interval to a more frequent reporting interval; (ix) an instruction to modify a current frequency to a different frequency; (x) an instruction to modify the current frequency to a specified frequency; (xi) an instruction to incrementally modify the current frequency to a different frequency; (xii) an instruction to modify a current communication protocol to a different communication protocol; (xiii) an instruction to modify the current communication protocol to a specified communication protocol, or any combination of such instructions. Further, these instructions may be based upon other train operation factors or conditions, as well as based upon environmental or geographical factors or conditions. Also, the instructions may be programmed on the on-board computer, populated in the track database 14, or configurable or activated by the operator. By allowing the issuance of such instructions, the system 100 facilitates direct or indirect communication between the train (T) and the wayside device (W) if the train (T), i.e., the on-board communication device 12 and/or the on-board computer 10, does not "hear" from the wayside device (W), i.e., the wayside communication device 20 and/or the wayside computer 22, or "understand" the data being transmitted by the wayside device (W).

As discussed above, if data is received at the on-board computer 10 (via the on-board communication device 12) from the wayside device (W) (via the wayside communication device 20), various actions may be initiated or implemented. In one exemplary embodiment, the action initiated or implemented includes at least one of the following: facilitate, initiate, and/or implement a train control action; facilitate, implement, and/or initiate a communication action; facilitate, implement, and/or initiate a data management action, or any combination thereof. In particular, and based at least partially on the receipt of data (and the content of that data) certain train control, communication, or data management functions can be facilitated, implemented, and/or initiated. For example, and based upon the receipt of the status of a configurable device, e.g., a switch, the train operation may be modified, the status of the device communicated to dispatch, and the track database 14 updated accordingly.

In another preferred and non-limiting embodiment, the track data 30 in the track database 14 includes at least one of the following: wayside device data (e.g., information or data associated with the wayside device (W) or its components), wayside communication device data (e.g., information or data associated with the wayside communication device 20), power level data (e.g., the actual, desired, sensed, measured, or specified power level of the transmission), interval frequency data (e.g., the actual, desired, sensed, measured, or specified reporting interval of the transmission), frequency data (e.g., the actual, desired, sensed, measured, or specified transmission frequency), communication protocol data (e.g., the actual, desired, sensed, measured, or specified communication protocol of the transmission), or any combination thereof. As discussed, any or a portion of the track data 30 can be used in setting, modifying, configuring, determining, or adjusting one or more of the power level, the reporting interval, the frequency, and/or the communication protocol.

In another preferred and non-limiting embodiment, the on-board computer 10 is programmed or configured to: determine locomotive (L) position in the track network based at least partially on at least a portion of the track data 30; determine upcoming wayside communication device 20 (or wayside device (W)) location in the track network based at least partially on the locomotive (L) position and at least a portion of the wayside communication device data; determine at least one of the following: a preferred power level, a preferred reporting interval, a preferred frequency, a preferred communication protocol, or any combination thereof, based at least partially on at least a portion of the wayside communication device data associated with the upcoming wayside communication device 20 in the track database 14; transmit, from the on-board communication device 12 to the upcoming wayside communication device 20, the preferred power level, the preferred reporting interval, the preferred frequency, the preferred communication protocol, or any combination thereof; and transmit data, from the upcoming wayside communication device 20 directly or indirectly to the on-board communication device 12, at or over at least one of the following: the preferred power level, the preferred reporting interval, the preferred frequency, the preferred communication protocol, or any combination thereof.

In another preferred and non-limiting embodiment, and as discussed above, the data transmissions between the on-board communication device 12 and the wayside communication device 20 is at least one of the following: in wireless form, over rails of the track (TR), or any combination thereof. Further, and in another preferred and non-limiting embodiment, the wayside device (W) may take the form of (or be in direct or indirect communication with) at least one of the following: a switch, a signal, a crossing device, a wayside interface unit, a gate, a safety device, a data collection device, a track control device, a configurable device, or any combination thereof.

In another preferred and non-limiting embodiment, provided is a wayside device (W) associated with a track network. The wayside device (W) includes, or is in direct or indirect communication with at least one wayside communication device 20, which is programmed or configured to transmit data at or over at least one of the following: at least one power level, at least one reporting interval, at least one frequency, at least one communication protocol, or any combination thereof. In particular, and in this embodiment, the data is transmitted directly or indirectly to the on-board computer 10 (via the on-board communication device 12) associated with the locomotive (L) of the train (T).

In another preferred and non-limiting embodiment, provided is a computer-implemented communication method for at least one train (T) having at least one locomotive (L) travelling in a track network having multiple wayside devices (W) associated therewith. In this embodiment, the method includes: transmitting data, by at least one wayside communication device 20 associated with one or more wayside devices (W), at or over at least one of the following: at least one power level, at least one reporting interval, at least one frequency, at least one communication protocol, or any combination thereof; and directly or indirectly receiving, by an on-board communication device 12 associated with the at least one locomotive (L) of the train (T), at least a portion of the transmitted data.

In a further preferred and non-limiting embodiment, provided is a locomotive-to-wayside device communication system for at least one train (T) having at least one locomotive (L) travelling in a track network having multiple wayside devices (W) associated therewith. The system includes: at least one on-board communication device 12 associated with the at least one locomotive (L) and programmed or configured to transmit and receive data; and at least one wayside communication device 20 associated with at least one of the wayside devices (W). In this embodiment, the wayside communication device 20 is programmed or configured to transmit data at or over at least one of the following: at least one power level, at least one reporting interval, at least one frequency, at least one communication protocol, or any combination thereof.

Figure 4:
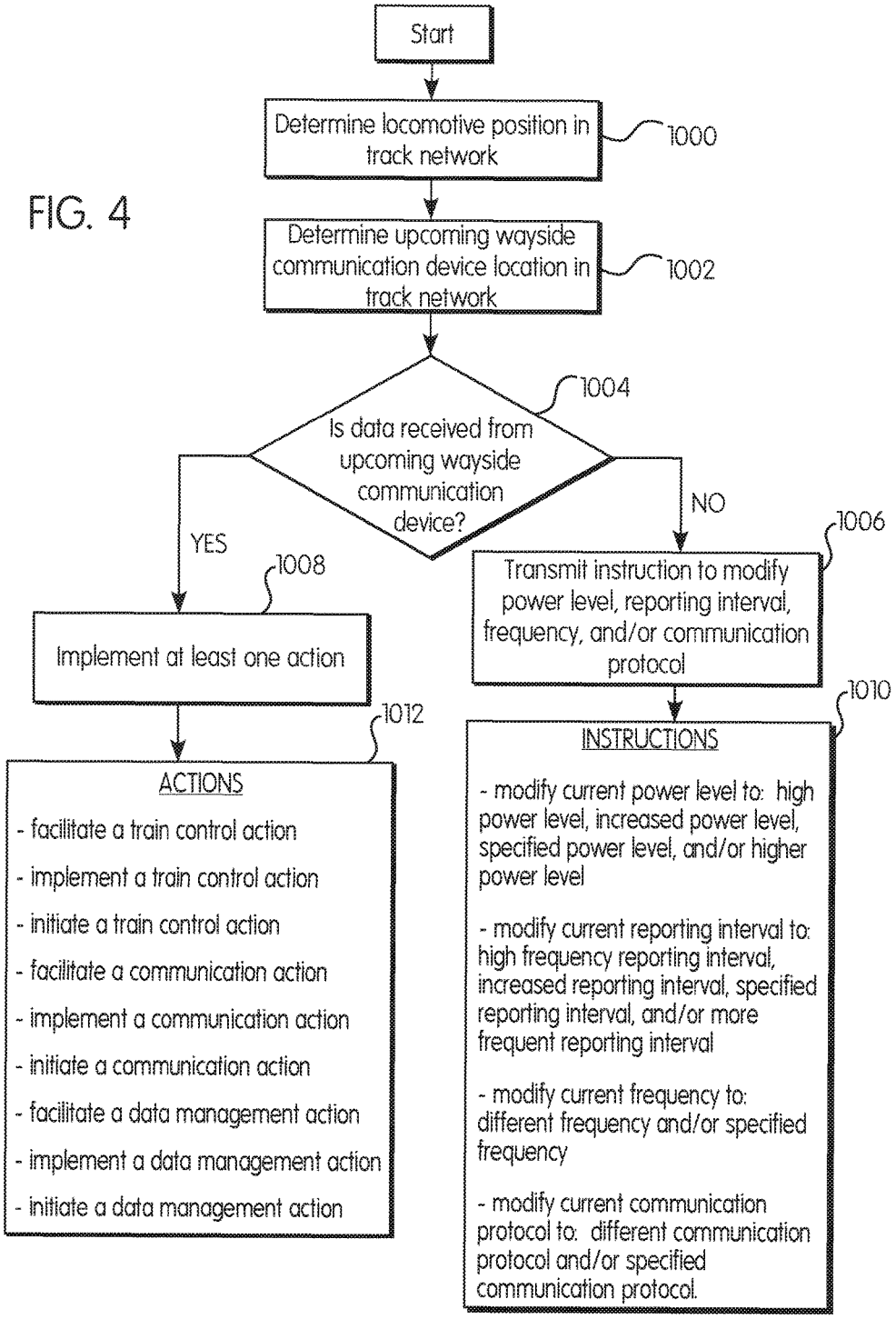
FIG. 4 is a flow diagram of a locomotive-to-wayside device communication method according to the principles of the present invention.

In a further preferred and non-limiting embodiment, and as illustrated in flow diagram form in FIG. 4, provided is a locomotive-to-wayside communication method for at least one train (T) having at least one locomotive (L) travelling in a track network having multiple wayside devices (W) associated therewith. This method includes: determining the locomotive (L) position in the track network (Step 1000); determining the location of the next or specified upcoming wayside communication device 20 (or some component of the wayside device (W)) (Step 1002); and determining whether data (and/or a specific type, set, or content of data) is received from the next or specified upcoming wayside communication device 20 (or some component of the wayside device (W)) (Step 1004). If no data is received (and/or the incorrect or an absence of the specific type, set, or content of data is received), the method includes transmitting an instruction to modify at least one of the following: the power level, the reporting interval, the frequency, the communication protocol, or any combination thereof (Step 1006).

In particular, and in one preferred and non-limiting embodiment (and as illustrated in Box 1010), these instructions include at least one of the following: (i) an instruction to modify a current power level to high power level; (ii) an instruction to modify the current power level to an increased power level; (iii) an instruction to modify the current power level to a specified power level; (iv) an instruction to incrementally modify the current power level to a higher power level; (v) an instruction to modify a current reporting interval to high frequency reporting interval; (vi) an instruction to modify the current reporting interval to an increased reporting interval; (vii) an instruction to modify the current reporting interval to a specified reporting interval; (viii) an instruction to incrementally modify the current reporting interval to a more frequent reporting interval; (ix) an instruction to modify a current frequency to a different frequency; (x) an instruction to modify the current frequency to a specified frequency; (xi) an instruction to incrementally modify the current frequency to a different frequency; (xii) an instruction to modify a current communication protocol to a different communication protocol; (xiii) an instruction to modify the current communication protocol to a specified communication protocol, or any combination thereof.

If, in the determination step 1004, data (and/or a specific type, set, or content of data) is received, at least one action is implemented (Step 1008). In particular, and in one preferred and non-limiting embodiment (and as illustrated in Box 1012), these actions include at least one of the following: facilitate, initiate, and/or implement a train control action (e.g., braking of the train (T) based upon information and data received from the wayside device (W), such as the status of a switch or gate); facilitate, implement, and/or initiate a communication action (e.g., contact another train (T) or central dispatch regarding the status of a wayside device (W), such as misaligned switch, a broken gate, a malfunctioning wayside device (W), etc.); facilitate, implement, and/or initiate a data management action (e.g., populate the track database 14 with updated status information for the wayside device (W)), or any combination thereof.

Accordingly, the present invention provides an innovative method for implementing and controlling communication with wayside devices (W), such as wayside radios, in Positive Train Control systems. For example, in one embodiment and as discussed above, the wayside communication device 20 may be transmitting at a pre-defined or configurable power level and at a pre-defined or specified reporting interval. For example, in high-traffic areas with commercial power available, the wayside communication device 20 may transmit at a maximum power at a frequent, e.g., three second, reporting interval. However, in remote areas, with battery power, the wayside communication device 20 may only be transmitting in the milliwatt power range, and at a much less frequent (e.g., one minute) reporting interval. As also discussed, the power level and the reporting interval (as well as the frequency and the communication protocol) may be configured at the wayside device (W).

In one exemplary and non-limiting embodiment, and when the locomotive (L) approaches the wayside device (W), but cannot "hear" from it, the on-board computer 10 will send a command (via the on-board communication device 12) to increase the transmission power, change the reporting interval, change the frequency, and/or change the communication protocol. In addition, and in one preferred and non-limiting embodiment, this command or instruction may start at a relatively low level or interval (or frequency) and gradually increase or be modified in subsequent commands until the on-board computer 10 receives data from the wayside communication device 20 at a desired distance. Still further, and in another embodiment, the track database 14 may also be populated with the desired power, reporting interval, frequency, and/or communication protocol for a group or set of wayside devises (W), or a specified wayside device (W).

In this manner, the present invention provides a unique and innovative system, method, and wayside device (W) that facilitate transmissions at variable levels, intervals, frequencies, and/or protocol. In one embodiment, this reduces radio frequency congestion by not having every wayside device (W) transmit at maximum power, and provides an opportunity to increase the power level (or any of the other levels discussed above) from a given wayside communication device 20 in a situational manner, such as in the instance where there is a variable amount of background noise to overcome. In particular, the radio frequency network congestion and interference would be lower, since each radio is only transmitting at the level necessary to hear it, and no higher.

In addition, another benefit of the present invention is that the provision of a variable reporting interval can further conserve energy by not having to respond at a current process of once every three seconds. Such an interval may be chosen for operation in signal territory, but remote locations running from battery power will generally be monitored switch locations. Less frequent status reporting of switch status versus signal status can be implemented.

Another advantage of the present invention with respect to power usage, and in one exemplary and non-limiting embodiment, a wayside device (W) or location may be running on battery power with one train per day that runs at 30 miles per hour with locomotive communication for three minutes in advance of the wayside location. Assuming that each full-power wayside transmission consumes five watts of battery power, under existing systems, such as wayside devices (W) reporting every three seconds, and where a location would be interrogated, the total power consumed per day may be about 300 watts. However, by implementing the presently-invented system, method, and wayside device (W), and by using a reporting interval of about one minute, with a low-power load consuming ten milliwatts of battery power per transmission and a high-power mode consuming five watts, the total power consumed in this example would be about 29.4 watts. Accordingly, the present invention represents a power savings with respect to existing systems.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A locomotive-to-wayside device communication system for at least one train having at least one locomotive travelling in a track network having a plurality of wayside devices associated therewith, the system comprising:

an on-board computer arranged in the at least one locomotive, the on-board computer programmed or configured to:

determine a position of the at least one locomotive in the track network;

determine that the at least one locomotive is approaching at least one upcoming wayside communication device based on the position of the at least one locomotive and a position of the at least one upcoming wayside communication device, the at least one upcoming wayside communication device configured to continuously or continually transmit data over at least one power level;

determine a new power level for the at least one upcoming wayside communication device; and transmit at least one command to the at least one upcoming wayside communication device, the at least one command configured to cause the at least one upcoming wayside communication device to modify the at least one power level to the new power level, wherein the new power level is determined by selecting a power level from a table of power levels based on the at least one upcoming wayside communication device or a power source of the at least one upcoming wayside communication device.

2. The locomotive-to-wayside device communication system of claim 1, wherein the at least one upcoming wayside communication device is powered by and comprises at least one of a battery and a solar panel.

3. The locomotive-to-wayside device communication system of claim 1, wherein the new power level is a higher power level than the at least one power level.

4. The locomotive-to-wayside device communication system of claim 1, wherein the new power level is a lower power level than the at least one power level.

5. The locomotive-to-wayside device communication system of claim 1, wherein the new power level is based on an identification of the power source of the at least one upcoming wayside communication device.

6. The locomotive-to-wayside device communication system of claim 1, wherein at least one of the on-board computer and the at least one upcoming wayside communication device is programmed or configured to identify an available power source for the at least one upcoming wayside communication device, and wherein the new power level is based on the identified available power source.

7. The locomotive-to-wayside device communication system of claim 1, wherein the at least one command is configured to cause the at least one upcoming wayside communication device to gradually modify the at least one power level to the new power level.

8. The locomotive-to-wayside device communication system of claim 1, wherein the at least one locomotive is determined to be approaching the at least one upcoming wayside communication device based at least partially on track data comprising the position of the at least one upcoming wayside communication device.

9. A locomotive-to-wayside device communication method for at least one train having at least one locomotive travelling in a track network having a plurality of wayside devices associated therewith, the method comprising:

determining, with at least one processor, a position of the at least one locomotive travelling in the track network;

determining, with at least one processor, that the at least one locomotive is approaching at least one upcoming wayside communication device based on the position of the at least one locomotive and a position of the at least one upcoming wayside communication device, the at least one upcoming wayside communication device configured to continuously or continually transmit data over at least one power level;

determining, with at least one processor, a new power level for the at least one upcoming wayside communication device; and transmitting, with an on-board communication device, at least one command to the at least one upcoming wayside communication device, the at least one command configured to cause the at least one upcoming wayside communication device to modify the at least one power level to the new power level, wherein determining the new power level comprises selecting a power level from a table of power levels based on the at least one upcoming wayside communication device or a power source of the at least one upcoming wayside communication device.

10. The locomotive-to-wayside device communication method of claim 9, wherein the at least one upcoming wayside communication device is powered by and comprises at least one of a battery and a solar panel.

11. The locomotive-to-wayside device communication method of claim 9, wherein the new power level is a higher power level or a lower power level than the at least one power level.

12. The locomotive-to-wayside device communication method of claim 9, further comprising identifying the power source of the at least one upcoming wayside communication device, wherein the new power level is based on the power source.

13. The locomotive-to-wayside device communication method of claim 9, wherein an on-board computer arranged in the at least one locomotive determines the position of the at least one locomotive and determines that the at least one locomotive is approaching the at least one upcoming wayside communication device, and wherein at least one of the on-board computer and the at least one upcoming wayside communication device determines the new power level.

14. The locomotive-to-wayside device communication method of claim 9, wherein the at least one command is configured to cause the at least one upcoming wayside communication device to gradually modify the at least one power level to the new power level.

15. The locomotive-to-wayside device communication method of claim 9, wherein the at least one locomotive is determined to be approaching the at least one upcoming wayside communication device based at least partially on track data comprising the position of the at least one upcoming wayside communication device.

16. A locomotive-to-wayside device communication system for at least one train having at least one locomotive travelling in a track network having a plurality of wayside devices associated therewith, the system comprising:

a wayside communication device positioned along the track network and programmed or configured to:

transmit data over at least one power level, the data receivable by locomotives approaching the wayside communication device;

receive at least one command from the at least one locomotive as the at least one locomotive approaches the wayside communication device; and in response to receiving the at least one command, modify the at least one power level to a new power level, wherein the new power level is a lower power level than the at least one power level, and wherein the at least one command causes the wayside communication device to gradually modify the at least one power level to the new power level; and an on-board computer arranged on the at least one locomotive, the on-board computer programmed or configured to:

determine a position of the at least one locomotive in the track network;

determine that the at least one locomotive is approaching the wayside communication device based at least partially on the position of the at least one locomotive in the track network;

determine the new power level by selecting a power level from a table of power levels based on the wayside communication device or a power source of the wayside communication device; and in response to determining that the at least one locomotive is approaching the wayside communication device, transmit the at least one command to the wayside communication device, wherein the at least one command specifies the new power level.

17. A locomotive-to-wayside device communication system for at least one train having at least one locomotive travelling in a track network having a plurality of wayside devices associated therewith, the system comprising:

an on-board computer arranged in the at least one locomotive, the on-board computer programmed or configured to:

determine a position of the at least one locomotive in the track network;

determine that the at least one locomotive is approaching at least one upcoming wayside communication device based on the position of the at least one locomotive and a position of the at least one upcoming wayside communication device, the at least one upcoming wayside communication device configured to continuously or continually transmit data over at least one power level;

identify an available power source for the at least one upcoming wayside communication device;

determine a new power level for the at least one upcoming wayside communication device based on the identified available power source; and transmit at least one command to the at least one upcoming wayside communication device, the at least one command configured to cause the at least one upcoming wayside communication device to modify the at least one power level to the new power level.

* * * * *